United States Patent [19]

Yoshida

[11] 4,172,549

[45] Oct. 30, 1979

[54] SPHERICAL PAPER PACKAGE

[76] Inventor: Kazuo Yoshida, No. 27-3, 3-chome, Iwatominami Komae City, Tokyo, Japan

[21] Appl. No.: 890,957

[22] Filed: Mar. 28, 1978

[30] Foreign Application Priority Data

Apr. 25, 1977 [JP] Japan ..... 52-51507[U]
Jul. 7, 1977 [JP] Japan ..... 52-89124[U]

[51] Int. Cl.[2] ..... B65D 5/32
[52] U.S. Cl. ..... 229/8
[58] Field of Search ..... 229/8

[56] References Cited

U.S. PATENT DOCUMENTS

| | | | |
|---|---|---|---|
| 643,420 | 2/1900 | Miyaji | 229/8 |
| 1,292,188 | 1/1919 | Wheeler | 229/8 UX |
| 1,861,206 | 5/1932 | Burgess | 229/8 X |
| 1,997,022 | 4/1935 | Stalker | 229/8 UX |
| 2,050,894 | 8/1936 | Paige | 229/8 X |
| 2,936,939 | 5/1960 | Lundquist | 229/8 |
| 3,124,293 | 3/1964 | Transport | 229/8 X |
| 3,248,807 | 5/1966 | Jamus | 229/8 X |
| 3,668,796 | 6/1972 | Patterson | 229/8 UX |
| 3,985,285 | 10/1976 | Kitagawa | 229/8 |

*Primary Examiner*—Davis T. Moorhead
*Attorney, Agent, or Firm*—Fleit & Jacobson

[57] ABSTRACT

A spherical paper package and a blank for making the same. One version of the blank has, arranged alternately and in parallel, a plurality of side sheets and folding sheets. The sheets are divided into three equal parts longitudinally by two transverse folding lines and are equally divided vertically by a plurality of longitudinal folding lines. Two diagonal folding lines are provided at the upper and lower portions of each of the folding sheets. The package is formed by folding the upper and lower portions of the folding sheets towards the center along the transverse folding lines. In another version, the transverse folding lines of the first version are replaced with transverse fold lines dividing each of the folding sheets in half. The fold lines cooperate with diagonal folding lines to form isosceles triangles.

7 Claims, 5 Drawing Figures

SPHERICAL PAPER PACKAGE

BACKGROUND OF THE INVENTION

1. Field of the Invention

This invention provides both a package or a container and a blank for forming a polygonal container which is nearly spherical.

2. Description of the Prior Art

In case of selling a commodity, such as a toy or the like, in a vending machine, the commodity is often packed in a spherical capsule made of plastic and sold by allowing the spherical capsule to fall down when coins are put into the vending machine. The spherical capsule made of plastic, however, has such defects as high cost, difficulty in beautiful printing on its surface, and the generation of an environmental pollution problem through waste disposal after the use thereof or the like.

SUMMARY OF THE INVENTION

This invention relates to a package and a blank for forming a spherical paper package having a quite novel form which is developed under the consideration of these traditional defects.

BRIEF DESCRIPTION OF THE DRAWINGS

Two embodiments according to this invention will be explained particularly with reference to the attached drawings, as follows.

Figure 1:
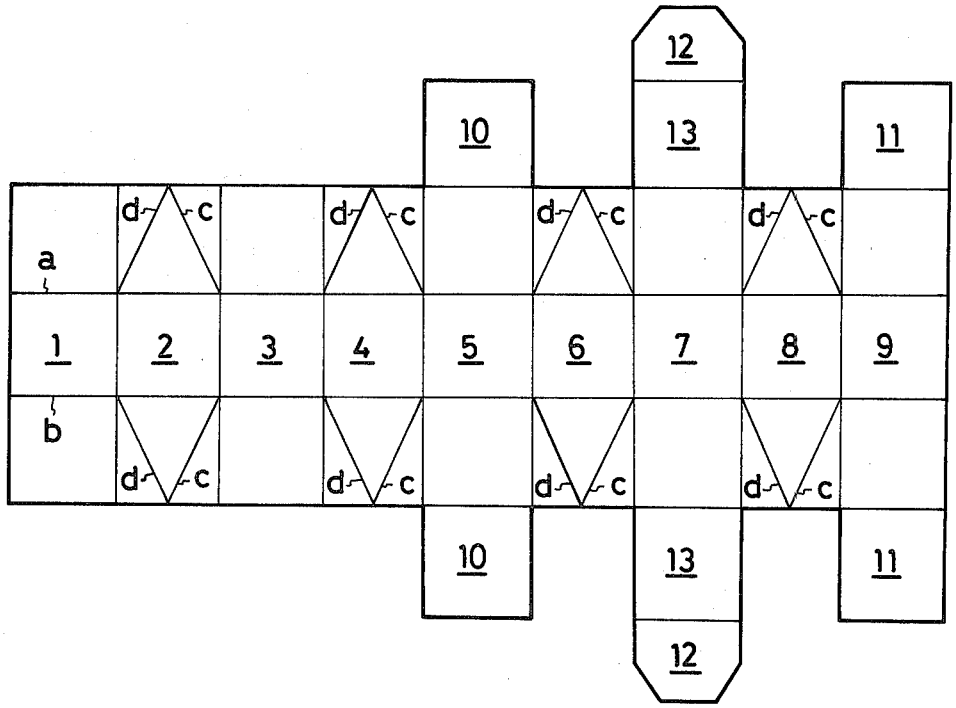
FIG. 1 is a plan view of a blank for a paper package in accordance with this invention.

Referring to the embodiment of the first example in accordance with this invention illustrated in FIG. 1, a blank is provided having a paste sheet 1, a folding sheet 2, a side sheet 3, a folding sheet 4, a side sheet 5, a folding sheet 6, a side sheet 7, a folding sheet 8 and a side sheet 9. The sheets are successively connected in order, respectively, from the left to the right by longitudinal folding lines. Transverse folding lines, a and b, are provided, by which said paste sheet 1, folding sheets 2, 4, 6 and 8, and side sheets 3, 5, 7 and 9 can be vertically divided into three equal parts respectively through the whole body. Further, two diagonal folding lines, c and d, are provided symmetrically with respect to the folding sheets 2, 4, 6 and 8. The diagonal folding lines cooperate with the transverse folding lines to define triangles having bases on the transverse folding lines, a and b, at the upper and lower portions of each folding sheet 2, 4, 6 and 8, respectively, and having apexes at the middle points of these folding sheets 2, 4, 6 and 8. Furthermore, lid sheets 10 and 11 are provided at the upper and lower ends of the side sheets 5 and 9, respectively, and are connected to the side sheets by transverse folding lines. In addition, lid sheets 13 having tongue pieces 12 at the end edges are provided at upper and lower portions of the side sheet 7. Thus, a whole body can be formed entirely from the blank.

Figure 2:
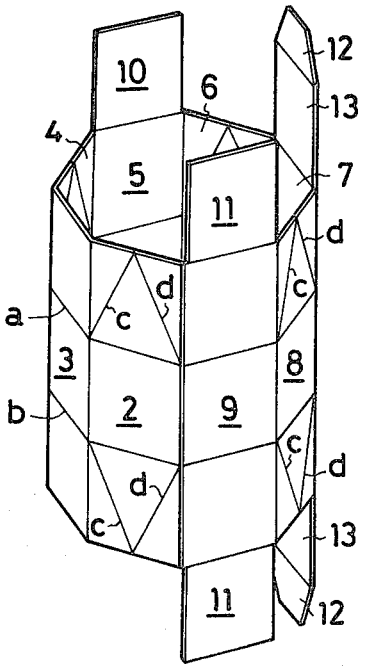
FIG. 2 is a perspective view of the blank of FIG. 1 partially folded to form a paper package.
Figure 3:
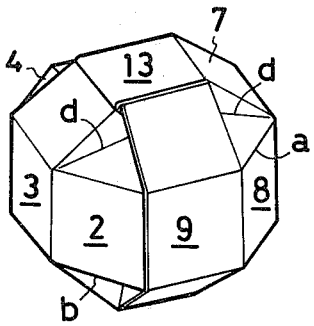
FIG. 3 is a perspective view after completion of the folding of the blank of FIG. 1.

In construction of a paper package from the blank of this invention, the blank, as shown in FIG. 2 and FIG. 3, is folded to form a case-like structure by sticking the paste sheet 1 to the side sheet 9. Then the upper and the lower portions of the folding sheets 2, 4, 6 and 8 are folded or piled on each other towards the center, along the transverse folding lines a or b and the diagonal folding lines c and d on the upper and lower sides or edges of these sheets. At the same time, the side sheets 3, 5, 7 and 9 are also folded on the folding lines a and b, whereby the central parts of the sheets between said transverse folding lines a and b are swelled extensively, like a band. The whole body of the folded blank forms a so-called spherical container which is gradually narrow towards the upper and lower ends of said body. The whole of the container can be formed by folding or piling up the lid sheets 10 and 11 alternately, folding the lid sheets 13 thereon, and inserting the tongue pieces 12 into the container to fix them, after putting the commodity into the paper package.

Figure 4:
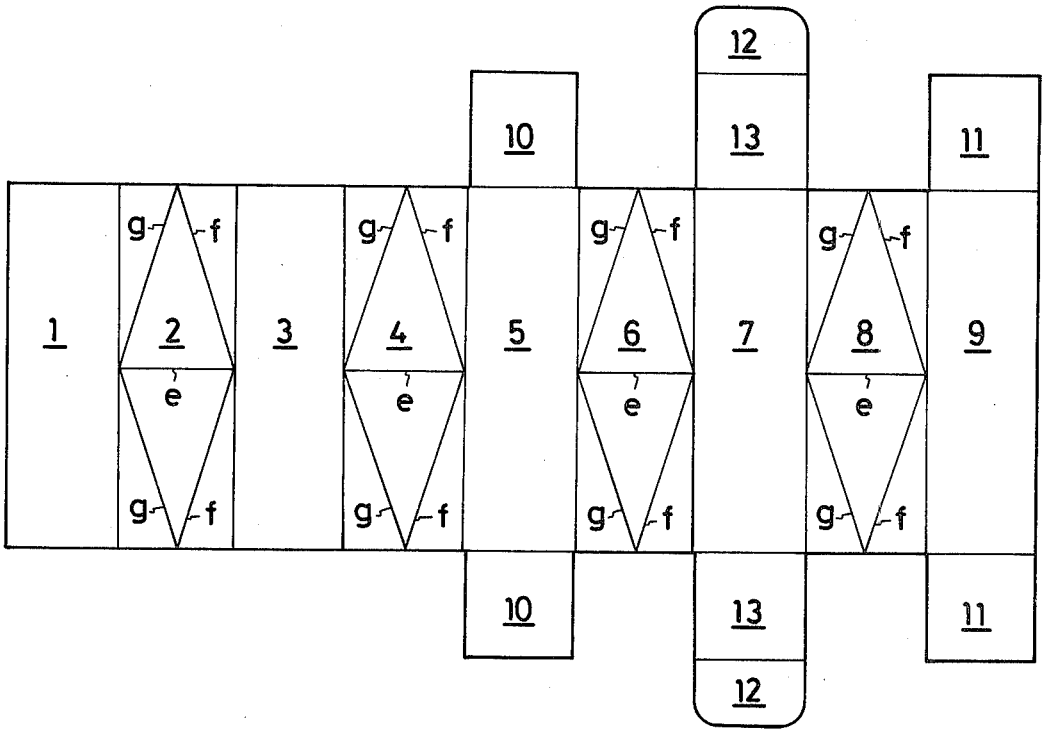
FIG. 4 is a plan view of another embodiment of a blank for a paper package in accordance with the present invention.
Figure 5:
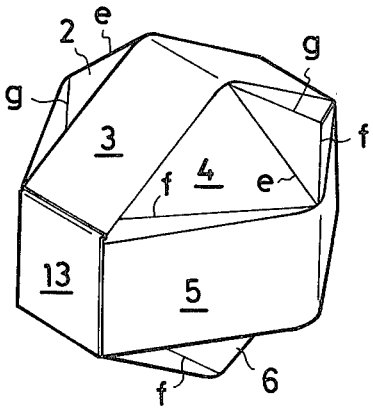
FIG. 5 is a perspective view, after folding of the blank of FIG. 4.

Referring to the second example of the blank for forming a paper package according to this invention, as illustrated in FIG. 4 and FIG. 5, the blank, when folded, forms a paper package having the shape of a rugbyball-like structure. With this embodiment, transverse folding lines e are provided at the central parts of the folding sheets 2, 4, 6 and 8 to divide these sheets into upper and lower portions. These folding lines replace the transverse folding lines a and b extending through the paste sheet 1, the side sheets 3, 5, 7 and 9, and the folding sheets 2, 4, 6 and 8, as shown in the first example. Further, the folding sheets of this embodiment are provided with two diagonal folding lines f and g that are symmetric with respect to the upper and lower portions of the folding sheets 2, 4, 6 and 8 defined by said transverse folding lines e. The lines e, f and g cooperate to define triangles, with bases of the triangles being defined by the lines e and the middle points of the upper and lower end edges of said folding sheets 2, 4, 6 and 8 defining apexes of the triangles.

Further, though four pieces of the side sheets and of the folding sheets in the examples described above are used alternately, the number of these sheets can be freely increased or decreased according to necessity. Furthermore, said folding lines may be machine-sewed so as to be easily folded.

In the blank for forming a paper package in accordance with this invention, the number of side sheets and folding sheets are arranged alternately through the longitudinal folding lines as described above, and said folding sheets are provided with the diagonal folding lines, thereby allowing folding along said folding lines towards the inner sides, in order. Accordingly, said paper package can be formed to be a spherical package which is swelled extensively at the central parts and is gradually narrow towards the sides. This package is characterized by being capable of receiving a toy, a cake, medicals or the like, and of accepting a beautiful printing on the surface thereof. Further, the package can be dumped without causing any environmental pollution. Thus it is possible to use the package for a vending machine or the like in various fields.

I claim:

1. A blank foldable to form a spherical paper package which comprises a plurality of side sheets arranged in parallel, a plurality of folding sheets arranged in parallel with said side sheets with a folding sheet disposed between adjacent side sheets, upper and lower longitudinally-extending folding lines for dividing said side and said folding sheets into approximately equal upper, middle and lower parts, two diagonal folding lines formed in the upper and lower parts of each folding sheet and cooperating with the longitudinally-extending folding lines to define isoceles triangles having bases located on the longitudinally-extending folding lines, first upper and lower lid sheets extending from upper and lower parts of one of said side sheets, second upper and lower lid sheets extending from upper and lower parts of another of said side sheets, said second lid sheets being foldable to overlap said first lid sheets when said blank is folded to form a package.

2. A blank according to claim 1, wherein a tongue sheet extends from one of the upper lid sheets and a tongue sheet extends from one of the lower lid sheets, the tongue sheets being foldable to releasably hold the lid sheets in an overlapped position.

3. A blank according to claim 2, wherein a paste sheet is disposed adjacent to a middle part of a sheet positioned at one end of the blank, the paste sheet being foldable into contact with the middle part of a sheet positioned at the other end of the blank.

4. A spherical paper package formed by folding a blank which comprises a plurality of side sheets arranged in parallel, a plurality of folding sheets arranged in parallel with said side sheets with a folding sheet disposed between adjacent side sheets, upper and lower longitudinally-extending folding lines for dividing said side and said folding sheets into upper, middle and lower approximately equal parts, two diagonal folding lines formed in the upper and lower parts of each folding sheet and cooperating with the longitudinally-extending folding lines to define isoceles triangles having bases located on the longitudinally-extending folding lines, first upper and lower lid sheets extending from upper and lower parts of one of said side sheets, second upper and lower lid sheets extending from upper and lower parts of another of said side sheets, said package being formed by moving the tops of the upper parts of the folding sheets towards each other, moving the bottoms of the lower parts of the folding sheets towards each other, and folding said second lid sheets to overlap said first lid sheets.

5. A blank foldable to form a paper package which comprises a plurality of side sheets arranged in parallel, a plurality of folding sheets arranged parallel with said side sheets with a folding sheet disposed between adjacent side sheets, each of said folding sheets having a transverse folding line for dividing the sheet into approximately equal upper and lower parts, two diagonal folding lines formed in each upper and lower part and cooperating with said transverse folding lines to define isosceles triangles having bases formed by said transverse folding lines and apexes positioned on outer edges of said upper and lower parts of said folding sheets, first upper and lower lid sheets extending from upper and lower parts of one of said side sheets, second upper and lower lid sheets extending from upper and lower parts of another of said side sheets, said second lid sheets being foldable to overlap said first lid sheets when said blank is folded to form a package.

6. A blank according to claim 5 wherein said lid sheets include cooperating means for releasably holding said lid sheets in a folded condition.

7. A paper package formed by folding a blank which comprises a plurality of side sheets arranged in parallel, a plurality of folding sheets arranged parallel with said side sheets with a folding sheet disposed between adjacent side sheets, each of said folding sheets having a transverse folding line for dividing the sheet into approximately equal upper and lower parts, two diagonal folding lines formed in each upper and lower part and cooperating with said transverse folding lines to define isosceles triangles having bases formed by said transverse folding lines and apexes positioned on outer edges of said upper and lower parts of said folding sheets, first upper and lower lid sheets extending from upper and lower parts of one of said side sheets, second upper and lower lid sheets extending from upper and lower parts of another of said side sheets, said package being formed by moving the tops of the upper parts of the folding sheets towards each other, moving the bottoms of the lower parts of the folding sheets towards each other, and folding said second lid sheets to overlap said first lid sheets.

* * * * *